US010525318B2

(12) United States Patent
Dougherty

(10) Patent No.: US 10,525,318 B2
(45) Date of Patent: Jan. 7, 2020

(54) TIMING DISPLAY DEVICE

(71) Applicant: Edmond J Dougherty, Wayne, PA (US)

(72) Inventor: Edmond J Dougherty, Wayne, PA (US)

(73) Assignee: Edmond J. Dougherty, Wayne, PA (US)

( * ) Notice: Subject to any disclaimer, the term of this patent is extended or adjusted under 35 U.S.C. 154(b) by 0 days.

(21) Appl. No.: 16/127,374

(22) Filed: Sep. 11, 2018

(65) Prior Publication Data

US 2019/0076714 A1 Mar. 14, 2019

Related U.S. Application Data

(60) Provisional application No. 62/557,308, filed on Sep. 12, 2017.

(51) Int. Cl.

| | |
|---|---|
| ***A63B 63/08*** | (2006.01) |
| ***F21V 33/00*** | (2006.01) |
| ***A63B 71/06*** | (2006.01) |
| *F21Y 115/10* | (2016.01) |

(52) U.S. Cl.

CPC ..... *A63B 63/083* (2013.01); *A63B 71/0622* (2013.01); *A63B 71/0669* (2013.01); *A63B 71/0686* (2013.01); *F21V 33/008* (2013.01); *A63B 2207/02* (2013.01); *A63B 2220/62* (2013.01); *A63B 2220/64* (2013.01); *A63B 2220/801* (2013.01); *A63B 2220/805* (2013.01); *A63B 2220/806* (2013.01); *A63B 2225/50* (2013.01); *F21Y 2115/10* (2016.08)

(58) Field of Classification Search

CPC ..... A63B 63/083; A63B 71/0669

See application file for complete search history.

(56) References Cited

U.S. PATENT DOCUMENTS

2010/0298075 A1* 11/2010 Paslay ..... A63B 63/083 473/479

* cited by examiner

*Primary Examiner* — Curtis B Odom

(74) *Attorney, Agent, or Firm* — Flaster/Greenberg P.C.

(57) ABSTRACT

A timing display device is defined by an extended length of indicator lights having a first end, a second end, and at least one intermediate location. A controller communicates with the indicator lights for controlled activation of the lights in a set pattern in conjunction with a clock sequence. The pattern of activating starts in the intermediate location and moves therefrom towards the ends of the extended length. The movement of the light activation includes a first and second projected color, wherein the first color is sequentially activated between the intermediate location and the two ends and the second color is sequentially activated from intermediate location towards the two ends, while overlapping the previously activated first color. The indicator lights may be light emitting diodes and the display may be affixed to a basketball backboard.

20 Claims, 6 Drawing Sheets

Red Yellow Green

Red Yellow Green

TIMING DISPLAY DEVICE

RELATED APPLICATION

The present disclosure claims the benefit of the filing date of U.S. Provisional Application No. 62/557,308 filed Sep. 12, 2017.

FIELD OF THE INVENTION

The present invention relates to device for displaying the time remaining in a timed segment of a game, sporting contest or similar activity using a combination of visual indicators that show motion, color and change in state.

BACKGROUND

A number of foams of timing and time indication mechanisms exist for games and sporting contests. Often these time indication mechanisms involve a clock, showing minutes, seconds and fractions of seconds. In sports such as basketball, the rules often dictate that a shot or other event occur within a fixed period of time. A shot clock is typically strategically positioned and provides an indication of the time remaining before the final deadline. Such timing clocks require the players to observe the clock and comprehend the significance of the typically digital display, all while attempting to avoid an opponent. The National Basketball Associate (NBA) director of technology has said that regardless of the numeric shot clock displays in stadiums and arenas that the players have difficulty keeping track of the time left on the clock because the game moves so fast. National Collegiate Athletic Association (NCAA) level basketball coaches have further indicated that throw-ins and backcourt timing is not properly timed because of the currently complexity. Further, in many states the shot clock is not used in high school leagues. As such, college bound basketball players require training in shot clock awareness.

In some existing basketball facilities, a series of lights are provided in a perimeter surrounding the central board area. These lights are normally turned off. The lights are linked to the clock device. When the clock time expires, the lights—typically light emitting diodes or LEDs that are red in color—are activated to provide a visual indication of the exact moment that the fixed deadline expired. This post time expiration light activation provides the referees, players and spectators with a measure of whether a shot (or other action) was timely taken or if any time remains for further play. This time expiration light activation may further be referred to in a video replay of the relevant portion of the game.

The basketball shot clock application will be used throughout this document to explain the concept of the contemplated invention. Similar time indicator applications are found in other games, sporting events and industrial applications. Example of non-sport related timing applications include, but are not limited to, a timer for kitchen ovens, a chemical process, classroom exams, board games, etc. Other sporting examples include, but are again not limited to soccer, American football, rugby, swimming and baseball.

SUMMARY

A timing display device is provided by a plurality of indicator lights having a first end, a second end, and at least one intermediate location. A timing controller is provided and communicates with the indicator lights for controlled activation of the lights in a set pattern in conjunction with a clock sequence. The initiation of the clock sequence is determined by a defined timing period, with the set pattern activating the indicator lights preferably starting in the intermediate location and moving therefrom towards the respective first and second ends. The timing and progression of the light activation is defined by the clock sequence. The indicator lights include a first and second projected color. The pattern starts with activation of the indicator lights in the first color and the movement between the intermediate location and the two ends. The pattern further includes a secondary activation of the indicator lights in the second color with the movement between the intermediate location and the two ends. The activation of the second color replaces the first color along plurality of lights.

Within the timing display device the indicator lights may include individual light elements, a light strip or a display. The lights may comprise light emitting diodes (LEDs) or similar elements. The clock sequence preferably activates individual lights in the pattern according to a fixed interval defined by the clock. The indicator lights may further include a primary projected color. The activation of the indicator lights in the first color and the movement between form intermediate location(s) towards the two ends may successively replace the primary color along the pattern. The indicator lights may include a third projected color, with the pattern including a tertiary activation of the indicator lights and the movement of the color activation between the intermediate location and the two ends, replacing the second color along the pattern of activation.

The timing display device as defined may be applied to a basketball backboard, of the type having a basket or hoop projected therefrom at the base of the backboard. The indicator lights are preferably attached to the backboard at a position spaced inward from an outer periphery of the backboard. As such, the indicator lights surround a central area of the backboard. As a further example, the clock sequence may define a shot clock time period. The activation of the first color is initiated during the shot clock time period and the completion of activation of the second color ends at the expiration of the shot clock time period. In the preferred basketball example, the intermediate location of the set pattern of the indicator lights is positioned on the backboard at a central location, adjacent to top and above the basket or hoop. The first and second ends of the pattern are preferably positioned at a central location adjacent the basket or hoop. The length of indicator lights may a frame of similar form to the backboard periphery. As such, for a rectangular backboard, the movement of the indicator lights first moves outwardly from the initial location and parallel to a top edge of the backboard, moves downward and parallel to the two side edges of the backboard, and closes by moving parallel to the bottom edge of the backboard towards the central location of the basket or hoop.

A timing display device may further be defined by a plurality of indicator lights formed in a strip that are activated for sequential illumination according to a timed sequence. The sequential illumination of the lights further includes a plurality of colors. The strip may include a first color along the light strip, with a second color initiating at a first location and serially activating the adjacent lights in the second color, replacing the first color. A third color may further activate in the pattern at the first location and serially replacing the second color. A clock communicates with the activator, with the sequence of illumination of the lights each defined by a fixed interval set by the clock and the initiation of the sequence determined by a defined timing period.

A timing display device may further be defined by an indicator strip and an activator for illuminating the strip in a sequential pattern. The pattern preferably includes display of a first color along the strip, a subsequent display of a second color starting at the first location and then successively displaying the second color at the adjacent locations along the strip. As such, the second color successively replaces the first color. A subsequent display of a third color preferably starts at defined location and successively displays the third color at the adjacent locations along the strip. Again, the third color successively replaces the second color along the strip. A clock communicates with the activator and the successive display within the sequential pattern is preferably defined by a fixed time interval. The display of the first color may initiate at a first location and the display successively shows the first color at adjacent locations according to the fixed interval of the clock. The first location may be located along the strip between a first end and a second end, and wherein the sequential pattern initiates at the first location with the successive activation moving from the first location towards both the first and second ends. The indicator strip may include a string of individual light emitting diodes (LEDs) or other elements of similar displaying nature.

BRIEF DESCRIPTION OF THE DRAWINGS

For the purpose of illustrating the invention, there is shown in the drawings a number of forms which are presently preferred; it being understood that the invention is not limited to the precise arrangements and instrumentalities shown.

DETAILED DESCRIPTION

Figure 1:
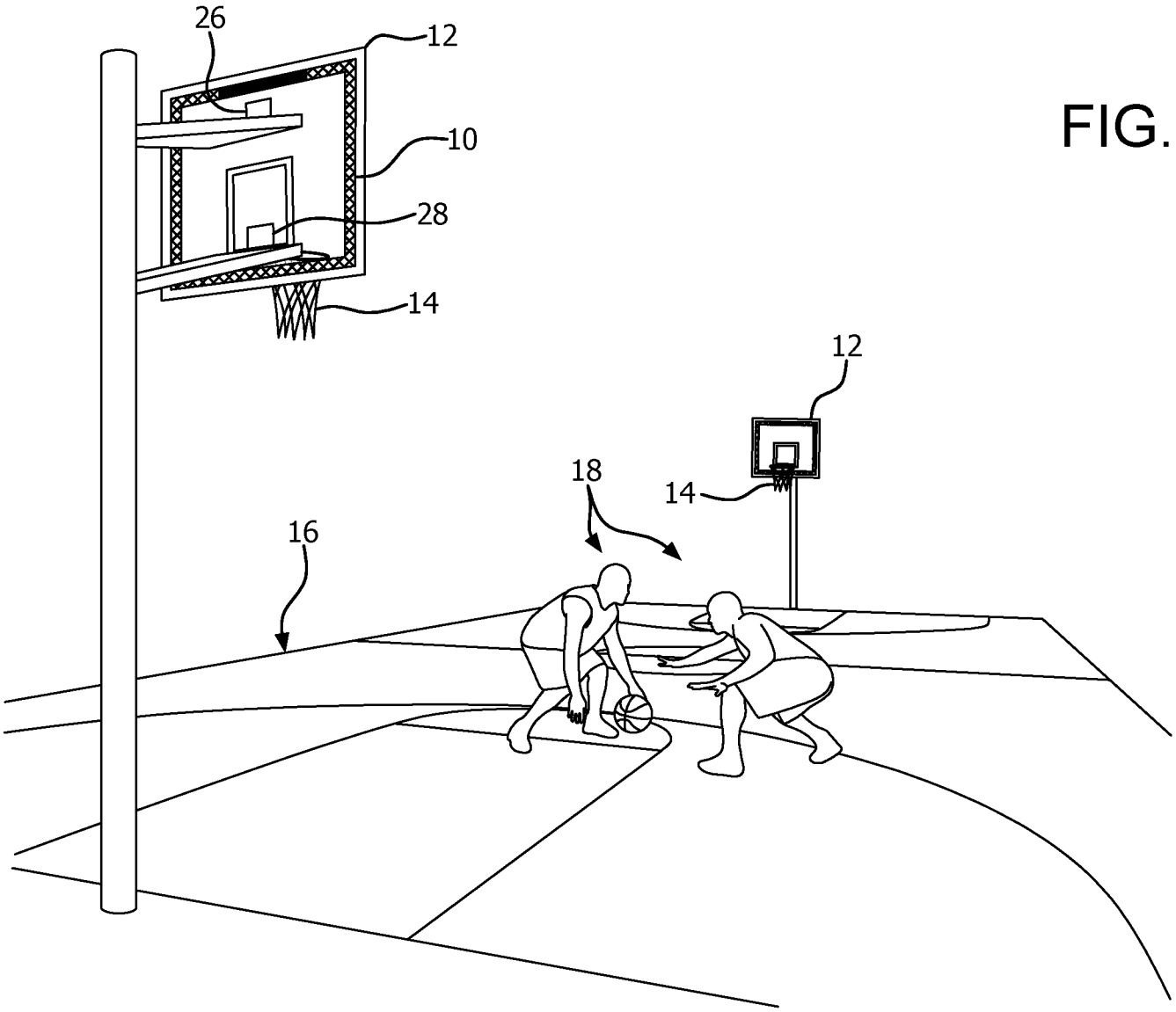
FIG. 1 illustrates a typical basketball court with two backboards each supporting a hooped rim or goal, with the timing display device included within the backboard.

Referring now to the drawings, where like numerals identify like elements, there is shown in FIG. 1 a timing display device, which is generally referred to by the numeral 10. In FIG. 1, the device 10 is shown attached to a basketball backboard 12 that includes a hoop or basket 14. There are two backboards 12 shown, one at each end of the court 16. Two players 18 are shown on the court 16. In the embodiment shown, the timing display device may serve as an indicator for the shot clock during the game, a back court time indicator, an out-of-bounds throw-in timer, or an end of period indicator. For purposes of the present disclosure the shot clock application will be discussed. In the basketball shot clock application, there is a defined time period for a player 18 on the offensive team to shoot the ball towards and strike or have the ball enter the rim of the basket. This defined time limit varies according to the rules of the relevant league.

As more particularly showing in the multiple views of the backboard 12 in FIGS. 2A to 2H, the device 10 encompasses a plurality, series or strip of indicator lights or elements 20, such as a plurality of light emitting diodes or LEDs. The length of the strip of indicator lights 20 extends in a pattern that matches the perimeter of the backboard 12. As presently illustrated, the backboard 12 is contemplated to be made of a clear Plexiglas material with a surrounding support frame. The indicator lights are preferably visible from the front and back of the backboard, permitting both the players and others in attendance at the game to view the lights 20. The sequence of preferred light activation is illustrated by the multiple views in FIG. 2. Generally, as the time progresses in the interval being measured, the indictor lights 20 are activated in such a way as to provide the players 18 and others (not shown) information regarding the amount of time left in the defined time interval.

Figure 2B:
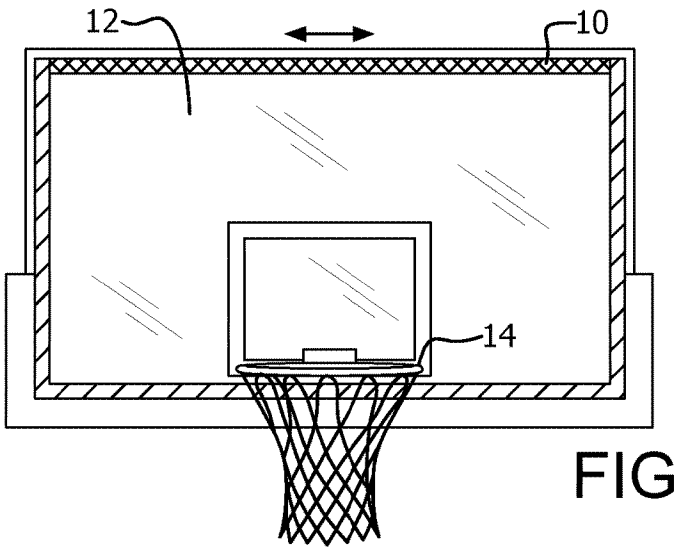
FIGS. 2A through 2H show a sequential movement of the indicator lights within a timing display device included within a basketball backboard.
Figure 2A:
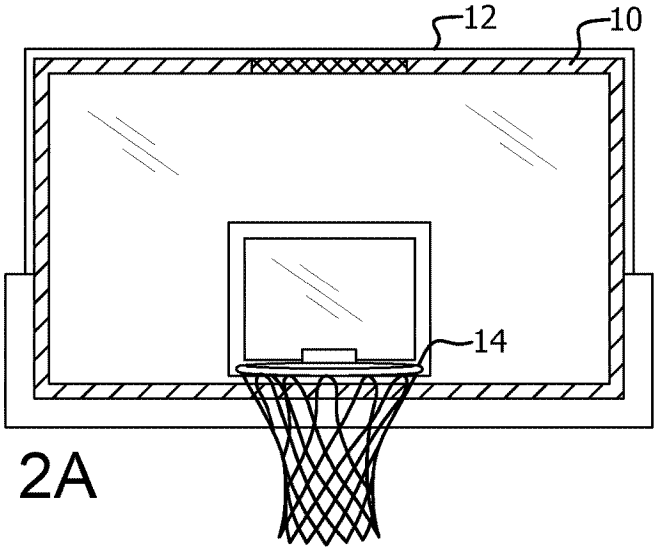
Figure 2D:
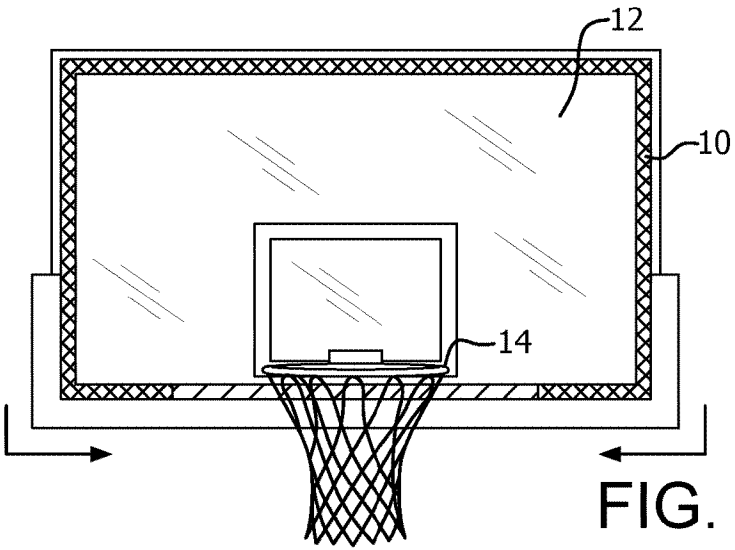
Figure 2C:
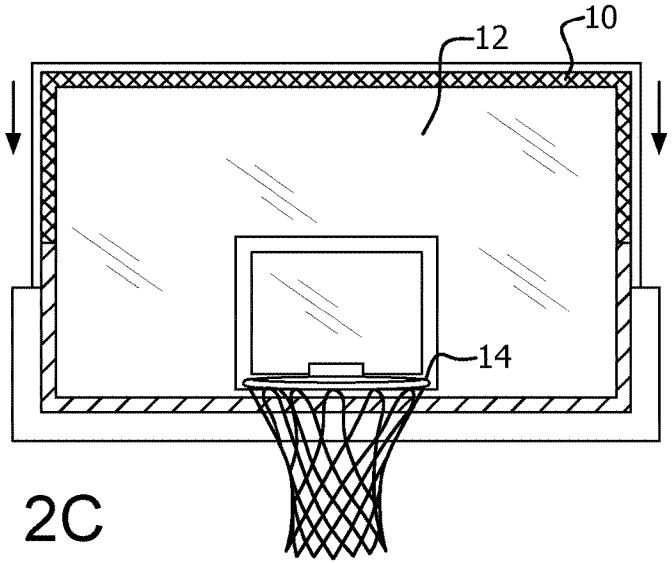

In FIG. 2A, the indictor light strip initially shows all the lights off, but at the start of the timing pattern, the perimeter fills with a green color sequence. Once the perimeter is filled with green lights, if the shot clock is still in effect, one or more of the lights 20 in the strip turn yellow. As shown, this initial color change is at an intermediate position located at the center of the top portion of the backboard 12. As the sequence continues, a successive number of lights change color from green to yellow. This activation pattern is first shown in FIG. 2B, where the length of yellow lights has increased over that shown in FIG. 2A. Further, the sequence of steps in the pattern extend away from the intermediate position towards the ends of the strip, which are illustrated to be at the bottom of the backboard, adjacent the basket. In FIG. 2C, activation of yellow lights continues along the sides edges of the backboard 12. In FIG. 2D, the yellow light activation is shown to continue down the sides and turn inward toward the end positions at the basket or hoop 14. The first activation sequence is completed when the yellow lights complete the circuit formed by the strip (not separately shown).

Figure 2F:
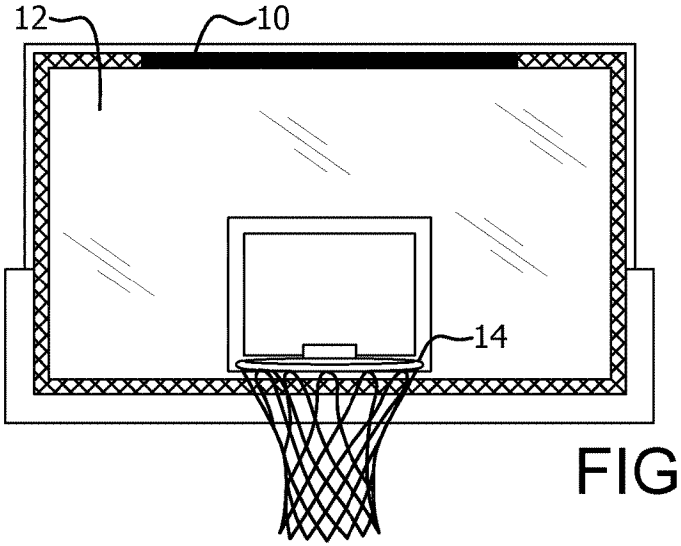
Figure 2E:
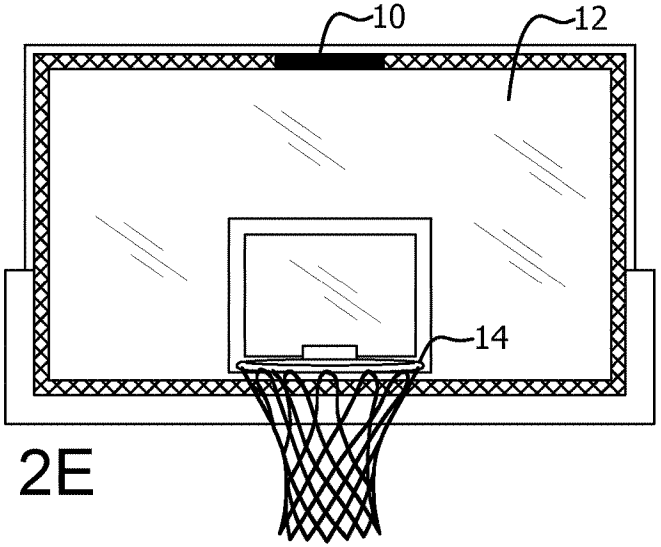
Figure 2H:
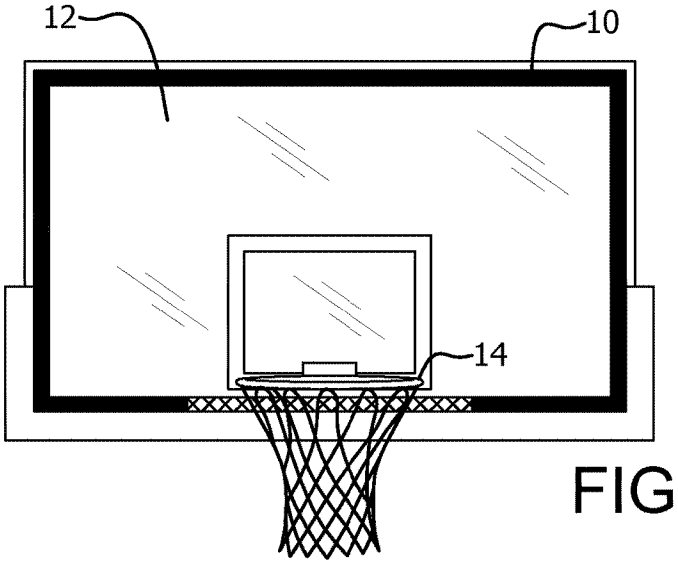
Figure 2G:
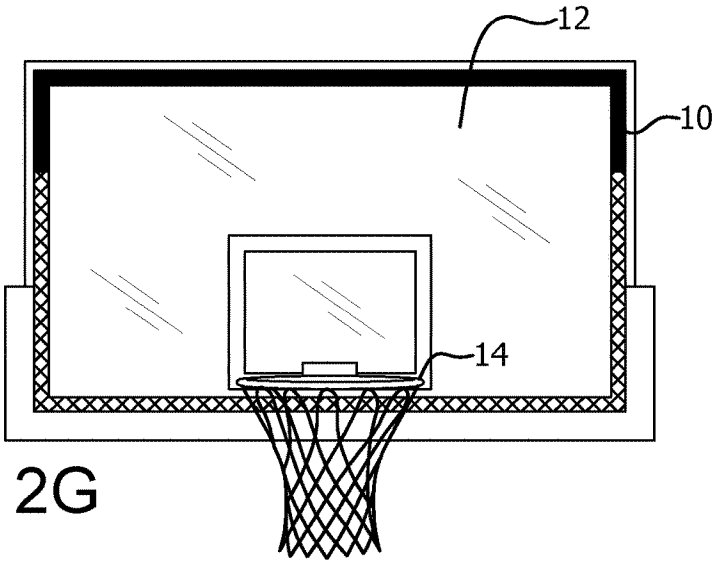

In FIG. 2E there is shown a second activation sequence whereby the completed yellow circuit of lights is sequentially replaced with red lights. The indicator lights 20 initially turn red at the start or intermediate position. In FIG. 2F, the lights 20 continue the second activation pattern by sequentially turning red on both sides of the initial position. In FIG. 2G, the red lights are now shown as extending down along the sides of the backboard. In FIG. 2H, the pattern continues with the red sequence heading along the bottom or base do the backboard, towards the basket. The sequence is contemplated to continue, such that when all lights 20 in the pattern indicate a red color, the defined time period has expired. A supplemental sound, color or light intensity change may be provided to further enhance the end of time indication.

As can be seen by the sequential pattern shown in FIG. 2, as the time progresses, the lights change color, position, etc. as the time remaining in the defined time interval is decreased. In the example of the basketball shot clock, at the start of the defined shot time period, or for a critical segment thereof, all of the lights around the perimeter of the backboard(s) may initially be off. As time progresses, indicator lights would begin to be illuminated. The illumination could be first in the green color. The first color illumination could by an activation of the entire strip or in a sequential one by one, or segment by segment, activation. The sequential activation of the colors creates a visual animation of the progress of the time period until all of the lights are lit, indicating that time has run out. The change in colors is a further indication of the time. The players would recognize that the change from green to yellow, as an example, defines a significant reduction in the amount of time remaining. The further extension of the yellow activation adds to the indication. The further change to red color and growing length and percentage of the overall length of the light strip provides a further indicator, without the need to process a specific numerical image.

In one implementation, the indicator lights 20 may be multicolored LEDs, sometimes referred to RGB LEDs or tricolor LEDS. The individual lights may be placed approximately 0.5 inches apart in the strip. In the example shown in FIGS. 1 and 2, the strip is placed closely spaced from the perimeter of the backboard. The color, and brightness level of each individual LED can be controlled by an electronic control circuit. Again, the timing period would start with all of the LEDs off, and an initial green LED or pluralities of LEDs at the top enter of the backboard would be illuminated. As controlled by the electronics, after an appropriate period of time, sequential illumination of additional LEDs would occur, preferably one on either side of the initial or intermediate position. The sequential activation of the LEDs provides the illusion that the LEDs are travelling around the perimeter of the backboard, moving towards each other at and end position, where to two portions of the length meet. Once fully outlined in green, the top center LED portion changes in color from green to yellow.

The initiation of the lights will depend on the set clock sequence. The overall game clock will determine when the indicator lights are first initiated. Moreover, there may be multiple modes programmed for and desired clock sequence. For example, in a shot clock application, there may be a recreational mode where in the lighting sequence is initiated from the moment the shot clock starts. In a college basketball game example, the lights may only activate during the last 10 seconds of the shot clock time. An example for use in the professional levels, the lights may initially activate during the last 5 seconds of the shot clock time. The lights would preferably follow the same pattern in each mode or application, but would move through the sequence at different rates, resulting in different speed of the perceived light movement.

Alternate colors may be utilized for different game time circumstances or as desired by the arena, team or league. For example, blue lights may be used to time throw-ins form out of bounds, where the player has 5 seconds to throw the ball inbounds once the referee gives it to the player. The lights would start when the ball is handed to the player and turned off once the player releases the ball. Once the 5 seconds times out, the lights surrounding the perimeter of the backboard would be fully illuminated.

As a further alternative example, white lights may provided to time backcourt/midcourt line crossing. The player may, for example, have 10 seconds to bring the ball across midcourt from the back court area. The light sequence would start when the ball is touched by the offensive player in the backcourt and be turned off once the ball crosses the midcourt line. Again, once the set times is completed, the lights surrounding the perimeter of the backboard would be fully illuminated indicating a timing violation.

Figure 3:
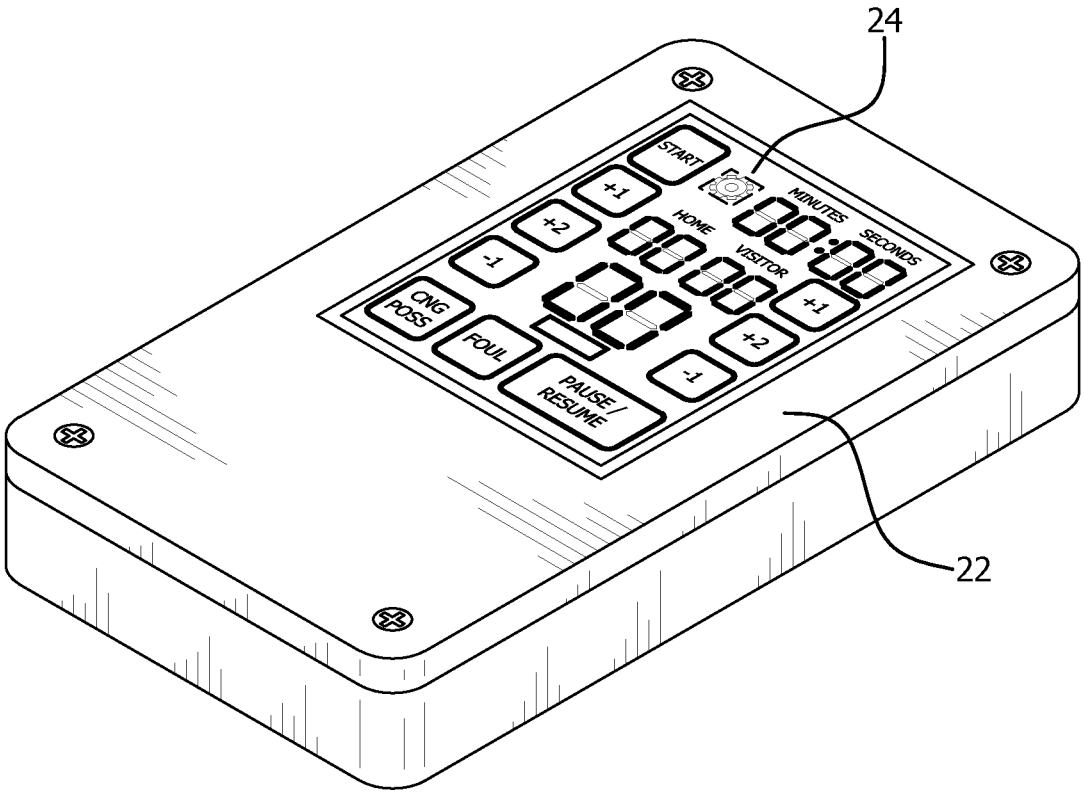
FIG. 3 shows a portable controller pad controlling the activation of a game clock and the display device.

A game control device is shown in FIG. 3 and is referred to by the numeral 22. The game control 22 as shown is contemplated to be sized so that it may be handheld by an individual. However, the game control may also be a table top device or may be included in computer software or incorporated into a cell phone app. The game control 22 has a screen 24 including information and activation buttons, or the like, thereon. The screen 24 may be fixed in nature or may be capable of switching from one form to another, depending on the desired read out or controls. The screen 24 may comprise fixed switches formed under a surface display or may be a touch screen with the switches being part of the display. The game control 22 preferably communicates with display controllers, which are generally identified in FIG. 1 by the numeral 26. The display controllers are used to set the sequential pattern of the indicator lights according to the clock preferably included in the game control 22.

Figure 5:
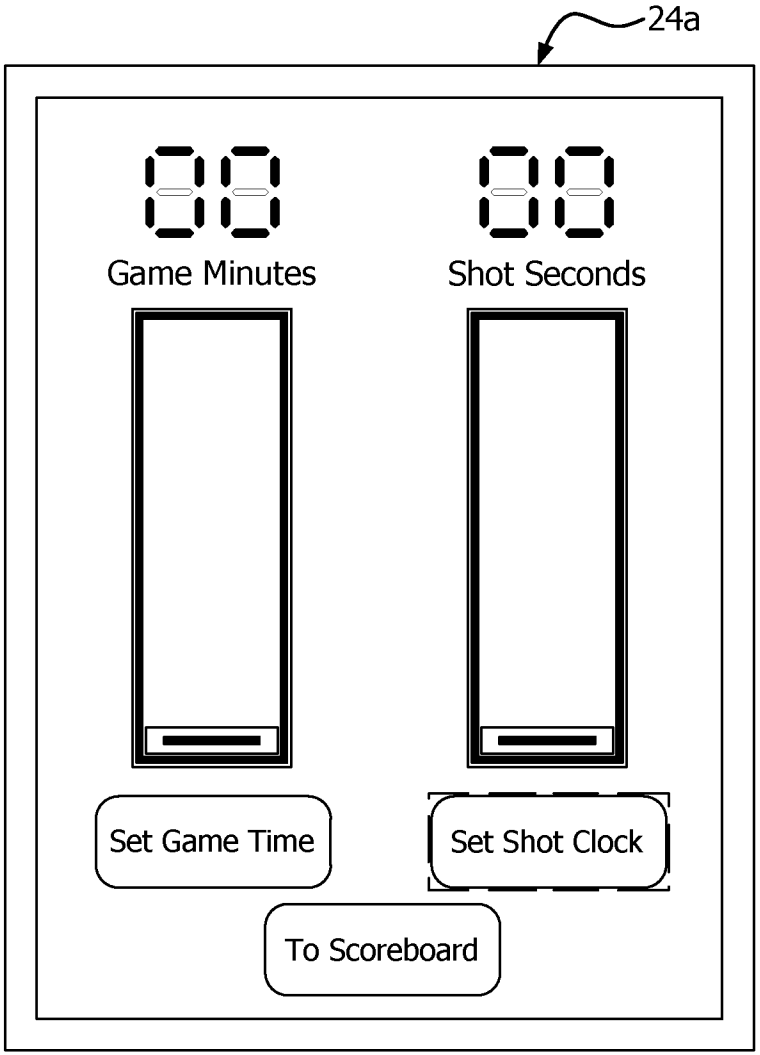
FIG. 5 shows a game clock and shot clock setup screen for a game controller the display device.
Figure 4:
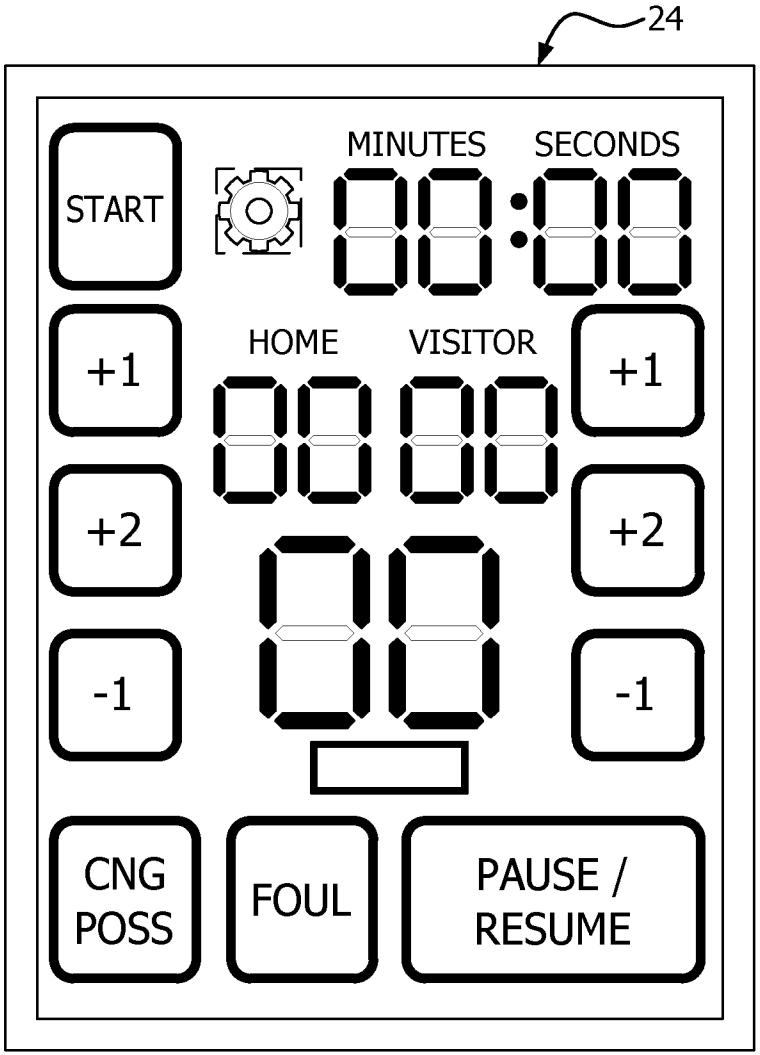
FIG. 4 shows a game control screen for a controller for use with the display device.

FIGS. 4 and 5 show different examples of screens for the controller 22. In FIG. 4, the information provided on the screen 24 is used to generally control the indication of the game score and clock. Additional activation buttons are provided for a basketball game, including change in possession ("CNG POSS") and foul ("FOUL"). FIG. 5 shows an alternate screen 24*a* for setting and controlling the game clock and other peripheral time sets, such as the shot clock time. This information, once set, may be transferred to the main score board. A reset of the shot clock, game clock or other time period may also accomplished through the controller screen.

Figure 6:
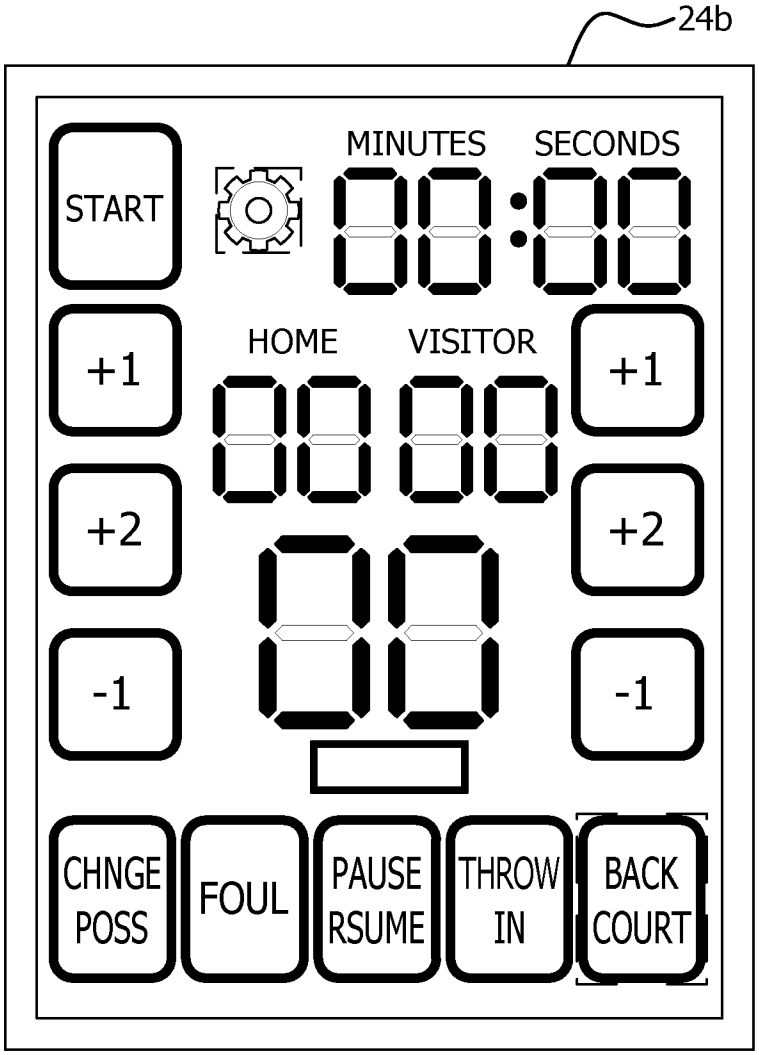
FIG. 6 shows a further game control screen for a controller for use with the display device.
Figure 7:
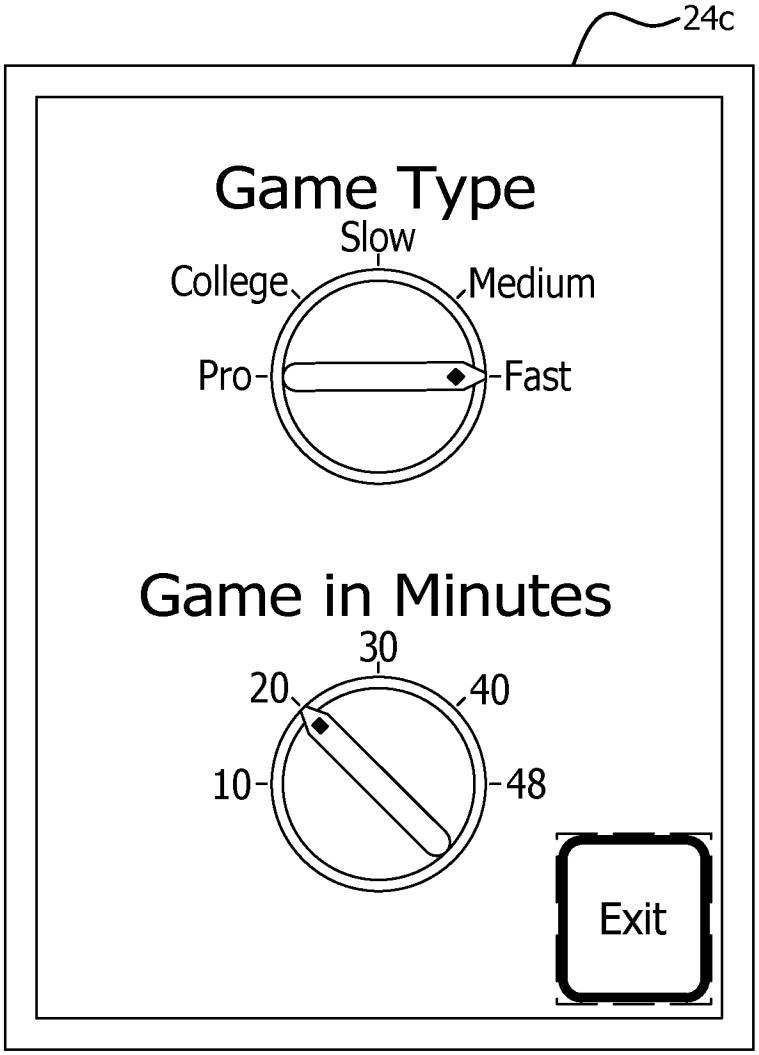
FIG. 7 shows a setup screen for a controller for use with the display device.

In FIG. 6 there is shown a further screen 24*b* that may be used to generally control the game clock and display device. Additional activation buttons are provided over those shown in FIG. 4. A "THROW IN" button is added to active the throw-in timer and the associated light sequence to be performed by the display device 10. A "BACK COURT" button is also provided for activation of the relevant timer and the associated light sequence to be performed by the display device 10. In FIG. 7, there is show a setup screen 24*c* for selection of alternate games, such as Pro, College, Slow, Fast and Medium. Other options may also be desired. Further, the overall time of the game may be set into the controller. Again, a specific lighting sequence may be programmed into the controller for the remaining seconds of the game or other relevant time period.

The game control 22 may be hardwired to the systems within a facility, game board, etc. or may communicate wirelessly. The game control may further communicate with other devices and displays. Typically all devices would be connected and coordinated via a wireless network such as Zigbee or WiFi.

Another way to signal the system as to the need to reset the display device, could be through the detection of various sensors. For example, a vibration sensor of the type generally identified in FIG. 1 by the number 28 may be provided. This sensor in the basketball application senses the strike of the ball on the rim of the basket, causing an automatic reset of the game shot clock and the display device 10. Other input devices, such as touch sensors, optical sensors, cameras and image processing systems may be included in the communication system for the display control 26 and the game control 22.

In the professional game mode, such as in the NBA or NCAA, for a game situation, the device 10 and color 26 may be placed on both backboards so the lights can be seen from virtually every position on the court. They can also be seen by spectators and any video broadcast cameras. In this situation, the timing of the lighting on the backboards would be synchronized to one another and to the official electronic shot clock. Some may prefer for the lights to become animated over the entire shot clock duration, or just the closing seconds (e.g. last 5 seconds) of the shot clock period.

In the full court practice mode, such as for an organized team practice, or a pick-up game when a coach or extra player is available but no formal game or shot clock mechanism is available, the lighting devices could be on both backboards and coordinated with each other, but with the addition of a separate, typically wireless, device that is able to allow a user to set the time limits of the game, the shot clock and keep track of the scoring.

In the half court practice mode, where the venue can be anything from a full scale arena to a backboard in a home's driveway, but where no one is available to enter data in the scoreboard device, a wireless wearable device can be used to by a player to reset the shot clock in situations where it is needed, such as in the case of a "steal" change of possession. By the action of the player wearing the device, the backboard system's shot time would be reset. This could be actuated, for example, by the player tapping the wearable device, using a wake word, pressing a button or some other means to signal the backboard system that the shot clock should be reset. The device could also signal the clock to pause, not just reset, in a similar manner, such as when the ball goes out of bounds. The actuation device would not have to be affixed to a person or persons, it could also be in a fixed position such as the pole that holds the backboard. Multiple actuation devices could also be used as wearables or fixed units.

In other sporting events, the display device couple be incorporated into the frame of the goal, such as a soccer or hockey goal or incorporated into the playing surface itself. Similarly, in a board game application, the indicator lights could be incorporated in to the board or on a separate apparatus associated with the game. Switches or sensors provided to the game participants may be used to control reset of the timing clock or the status of the lights with display.

In the drawings and specification, there has been set forth a number of embodiments of the invention and, although specific terms are employed, these terms are used in a generic and descriptive sense only and not for purposes of limitation. The scope of the invention is set forth in the following claims.

What is claimed is:

1. A timing display device comprising:

an extended length of a plurality of indicator lights having a first end, a second end, and at least one intermediate location, a timing controller communicating with the indicator lights for controlled activation of the lights in a set pattern in conjunction with a clock sequence, the initiation of the clock sequence determined by a defined timing period, the set pattern activating the indicator lights starting in the intermediate location and moving therefrom towards the respective first and second ends of the extended length, the movement of the light activation defined by the clock sequence, and wherein the indicator lights include a first and second projected color, the set pattern including a first activation of the indicator lights in the first color through the movement between the intermediate location and the two ends, and the set pattern including a secondary activation of the indicator lights in the second color through the movement between the intermediate location and the two ends, the activation of the second color replacing the first color along the pattern of activation.

2. A timing display device as claimed in claim 1, wherein in each indicator light comprises a light emitting diode (LED).

3. A timing display device as claimed in claim 1, wherein the clock sequence activates individual lights in the set pattern according to a fixed interval.

4. A timing display device as claimed in claim 1, wherein the indicator lights include a primary projected color, wherein the activation of the indicator lights in the first color through the movement between the intermediate location and the two ends successively replaces the primary color along the pattern.

5. A timing display device as claimed in claim 1, wherein the indicator lights include a third projected color, and the set pattern includes a tertiary activation of the indicator lights in the third color through the movement between the intermediate location and the two ends, the activation of the third color replacing the second color along the pattern of activation.

6. A timing display device as claimed in claim 1, further comprising a basketball backboard and a basketball hoop projected therefrom at the base of the backboard, wherein the indicator lights are attached to the backboard at a position adjacent an outer periphery of the backboard and surrounding a central area of the backboard.

7. A timing display device as claimed in claim 6, wherein the clock sequence is a defined shot clock time period, wherein the first activation of the first color is initiated during the shot clock time period and the completion of the secondary activation of the second color and the ends of the extended length of lights.

8. A timing display device as claimed in claim 6, wherein the intermediate location of the set pattern of the indicator lights is positioned on the backboard at a central location that is above the projected hoop.

9. A timing display device as claimed in claim 8, wherein the first and second ends of the set pattern of the indicator lights are each positioned at a central location adjacent the projected hoop.

10. A timing display device as claimed in claim 9, wherein the length of indicator lights extend from the intermediate position in a defined frame located parallel to a top edge of the backboard, parallel to two side edges of the backboard, and parallel to a bottom edge of the backboard.

11. A timing display device as claimed in claim 10, wherein the backboard has a rectangular shape.

12. A timing display device comprising:

a plurality of indicator lights formed in a strip, an activator for sequentially illuminating the indicator lights according to a timed sequence, the sequential illumination of the indicator lights including a plurality of colors, the activator initiating a first color along the light strip, the activator initiating a second color at the first location and serially activating lights adjacent to the first location in the second color, the second color replacing the first color during the serial activation, the activator initiating a third color at the first location and serially activating lights adjacent to the first location in the third color, the third color replacing the second color during the serial activation, and a clock communicating with the activator, the sequence of illumination of the lights each defined by a fixed interval set by the clock, and the initiation of the sequential display determined by a defined timing period.

13. A timing display device as claimed in claim 12 wherein the activation of the first color initiates at the first location and the adjacent lights serially activate in the first color along the strip.

14. A timing display device as claimed in claim 12 wherein the indicator light strip comprises a first end and a second end, and wherein an activation pattern of the indicator lights is completed when all lights are activated between the first and second ends.

15. A timing display device as claimed in claim 14 wherein the first location is located between the first end and the second end, and wherein the activation pattern initiates at the first location with the serial activation extending form the first location towards both the first and second ends.

16. A timing display device as claimed in claim 15 wherein in each indicator light in the strip comprises a light emitting diode (LED).

17. A timing display device comprising:

an indicator strip, an activator for illuminating the strip in a sequential pattern including display of a first color along the strip, a subsequent display of a second color at the first location on the strip and successively displaying the second color at locations adjacent to the first location along the strip, the second color successively replacing the first color along the strip, a subsequent display of a third color at the first location on the strip and successively displaying the third color at locations adjacent to the first location along the strip, the third color successively replacing the second color along the strip, a clock communicating with the activator, the successive display within the sequential pattern each having a fixed interval defined by the clock, and the initiation of the successive display in the pattern determined by a defined timing period.

18. A timing display device as claimed in claim 17 wherein the display of the first color initiates at a first location and successively displays the first color at adjacent locations along the strip according to the fixed interval of the clock.

19. A timing display device as claimed in claim 18 wherein the first location is located along the strip between a first end and a second end, and wherein the sequential pattern initiates at the first location with the successive activation moving from the first location towards both the first and second ends.

20. A timing display device as claimed in claim 19 wherein the indicator strip comprises a string of individual light emitting diodes (LEDs).

* * * * *